United States Patent [19]

Arita

[11] 4,425,200

[45] Jan. 10, 1984

[54] METHOD AND APPARATUS FOR STABILIZING ALUMINUM METAL LAYERS IN ALUMINUM ELECTROLYTIC CELLS

[75] Inventor: Yoji Arita, Yokohama, Japan

[73] Assignee: Mitsubishi Keikinzoku Kogyo Kabushiki Kaisha, Tokyo, Japan

[21] Appl. No.: 309,066

[22] Filed: Oct. 6, 1981

[30] Foreign Application Priority Data

Oct. 8, 1981 [JP] Japan ..... 55-140918

[51] Int. Cl.[3] ..... C25C 3/06; C25C 3/08; C25C 3/20

[52] U.S. Cl. ..... 204/67; 204/243 M

[58] Field of Search ..... 204/67, 243 M

[56] References Cited

U.S. PATENT DOCUMENTS

| | | | |
|---|---|---|---|
| 2,880,157 | 3/1954 | Wleugel | 204/243 M |
| 3,063,919 | 11/1962 | Jouquet et al. | 204/67 |
| 3,719,577 | 3/1973 | Robl et al. | 204/243 |
| 4,196,067 | 4/1980 | Friedli | 204/243 |

FOREIGN PATENT DOCUMENTS

| | | | |
|---|---|---|---|
| 167946 | 7/1956 | Australia | 204/243 M |

*Primary Examiner*—Howard S. Williams

*Attorney, Agent, or Firm*—Oblon, Fisher, Spivak, McClelland & Maier

[57] ABSTRACT

In an aluminum electrolytic cell in which alumina is electrolyzed by electric current flowing between an anode electrode and a cathode electrode, ferromagnetic rods are disposed on the anode electrode in parallel with a shorter end wall of the cell. The ferromagnetic rod is magnetized by a horizontal component of a magnetic field created in the cell by the current to produce a magnetic field containing a vertical component that decreases a gradient of a vertical component of the magnetic field created by the current. The magnetic member may be disposed above or below an aluminum metal layer or above the anode electrode. In the last mentioned case, a ferromagnetic bar may be wound about an anode supporting rod to form a coil having opposite terminals extending in the horizontal direction.

8 Claims, 9 Drawing Figures

METHOD AND APPARATUS FOR STABILIZING ALUMINUM METAL LAYERS IN ALUMINUM ELECTROLYTIC CELLS

BACKGROUND OF THE INVENTION

This invention relates to a method and apparatus for stabilizing an aluminum metal layer in an aluminum electrolytic cell. Electrolysis of aluminum is usually carried out by serially connecting a plurality of rectangular electrolytic cells through anode and cathode bus bars to form a pot line or cell group and passing a large DC current of the order of 50 to 300 kiloamperes through the pot line to electrolyze alumina contained in respective cells. A well known arrangement of the electrolytic cells is of a so-called double entry type in which the electrolytic cells are arranged in a side-by-side relation or an end-to-end relation with respect to the direction of flow of the current, so as to supply current from both sides of each cell. With this type of the cell arrangement, since the cathode bus bars carrying large current extend along the side surfaces of the electrolytic cells a strong magnetic field is created in the electrolytic cells.

In each cell, the current supplied from an anode bus bar flows to an electrolytic bath through one or more anode electrodes to reach an aluminum metal layer formed as the result of electrolysis, then flows to a cathode bed carbon to be collected by a plurality of cathode bars disposed parallel with the shorter end wall of a steel container and finally is taken out through a cathode bus bar extending along the longer side wall of the steel container. While being collected by the cathode bars, the cell current tends to concentrate in a current path having a small electric resistance so that a portion of the current flown out from an anode electrode at the central portion of the cell does not flow through a path immediately below that anode and perpendicular thereto but instead flows directly through a path leading to a cathode bar disposed near the longer side wall of the steel container. As a consequence, the current flows in the horizontal direction in the cell, particularly in an aluminum metal layer, from the longitudinal center line of the cell to the longer side wall of the steel container. Such horizontal current also flows through the aluminum metal layer when a solidified bath or freeze formed on the cell wall or sludge in the aluminum metal electrically insulates the cathode bed carbon during the operation of the cell.

The horizontal current in the aluminum metal layer undergoes natural action with the magnetic field to agitate or fluctuate to form curved or oscillatory surfaces on the aluminum metal layer. Especially, when the vertical component of the magnetic field has its inclination to the horizontal direction it produces a nonuniform pressure distribution in the aluminum metal which enhances the curved state on the upper surface of the aluminum metal layer.

When the aluminum metal layer becomes unstable as above described, the aluminum metal layer may come into direct contact with the lower surface of the carbon anode electrode with the result that the current flows through such contacted portion, thereby greatly decreasing the current efficiency.

As a result of an exhaustive investigation, I have found that the aluminum metal layer can be efficiently stabilized where a ferromagnetic member is horizontally disposed above or below the aluminum metal layer so as to cause the vertical component of the magnetic field created by the ferromagnetic member to cancel the vertical component of the magnetic field created by the cell itself thereby decreasing the inclination or gradient of the vertical component.

SUMMARY OF THE INVENTION

Accordingly, it is an object of this invention to provide an efficient method and apparatus for stabilizing an aluminum metal layer in an aluminum electrolytic cell by preventing agitation or fluctuation of the aluminum metal layer and hence curved or oscillatory state of the upper surface of the aluminum metal layer.

Another object of this invention is to provide apparatus for stabilizing an aluminum metal layer in an aluminum electrolytic cell, which has a simple construction and can readily be incorporated into the electrolytic cell but can increase the current efficiency by always maintaining an adequate interelectrode spacing.

According to one aspect of this invention there is provided a method of stabilizing an aluminum metal layer in an aluminum electrolytic cell comprising the steps of horizontally disposing a ferromagnetic member in a magnetic field created by a current passing through the electrolytic cell, and magnetizing said ferromagnetic member with a horizontal component of said magnetic field so as to form a magnetic field containing a vertical component that decreases a gradient of a vertical component of said first mentioned magnetic field.

According to another aspect of this invention there is provided an apparatus for stabilizing an aluminum metal layer in an electrolytic cell in which alumina is electrolyzed by electric current flowing through an electrolyte interposed between at least one anode electrode and a cathode electrode, said apparatus comprising at least one horizontal ferromagnetic member disposed in a magnetic field created by a current passing through said electrolytic cell to be magnetized with a horizontal component of said magnetic field for forming a magnetic field containing a vertical component that decreases a gradient of a vertical component of said first mentioned magnetic field.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
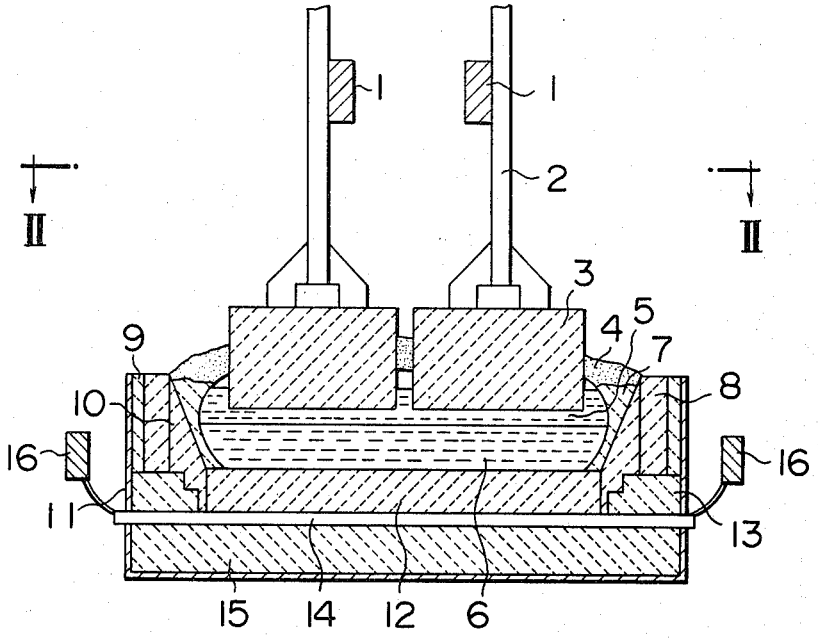
FIG. 1 PRIOR ART
FIG. 1 is a diagrammatic vertical sectional view showing a typical aluminum electrolytic cell to which the present invention is applicable.

A typical prior art aluminum electrolytic cell shown in FIG. 1 comprises anode bus bars 1, a plurality of anode rods 2, prebaked anode electrodes 3 respectively supported by the anode rods 2, alumina 4, an electrolytic bath 5, a molten aluminum metal layer 6, a freeze or a solidified bath 7, carbon slabs 8, side heat insulating bricks 9, a side carbonaceous lining 10, a steel container 11, a cathode carbon block 12, heat insulating bricks 13 supporting the heat insulating bricks 9 and the carbon slabs 8, a cathode bar 14, a bottom heat insulating brick 15 and cathode bus bars 16. Since the construction and operation of the aluminum electrolytic cell shown in FIG. 1 is well known in the art it is believed unnecessary to describe them in detail.

Figure 2:
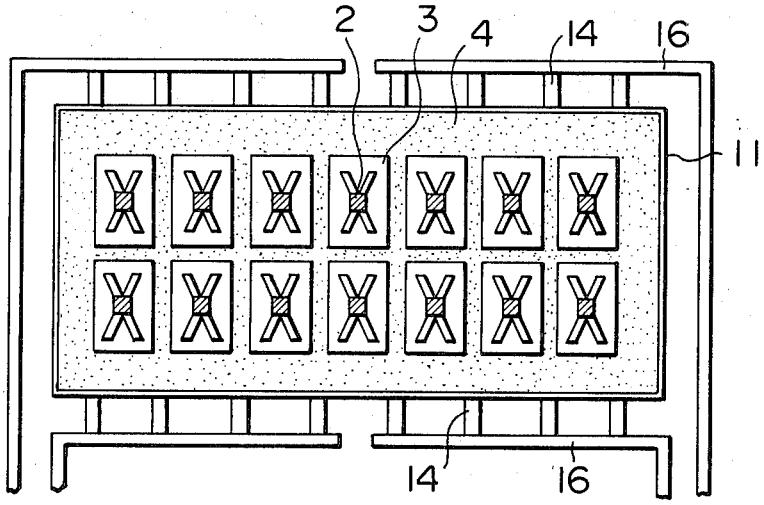
FIG. 2 PRIOR ART
FIG. 2 is a diagrammatic plan view of the cell shown in FIG. 1 taken along a line II—II.
Figure 3:
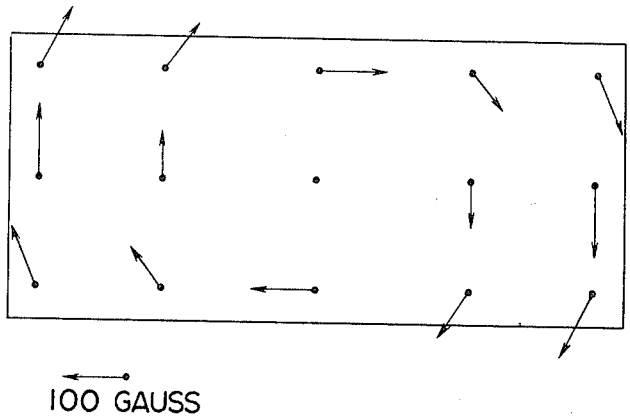
FIG. 3 is a graph showing the distribution of the horizontal component of the magnetic field in the electrolytic cell shown in FIGS. 1 and 2.
Figure 4:
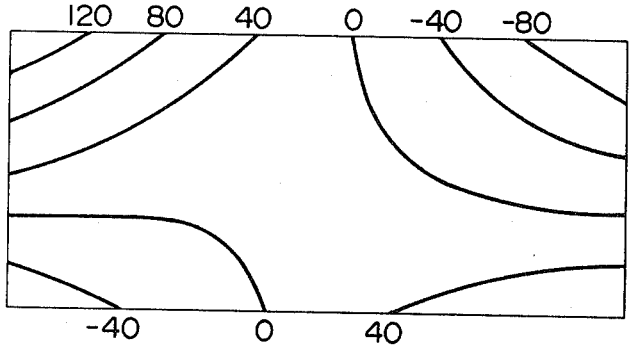
FIG. 4 is a graph showing the distribution of the vertical component of the magnetic field in terms of Gauss units of the same electrolytic cell.

FIG. 2 shows a plan view of the cells in which a number of electrolytic cells shown in FIG. 1 are arranged in a side-by-side relation to form a double entry type cell assembly. One example of the distribution of the horizontal and vertical components of the magnetic field in the electrolytic cell of the type shown in FIG. 1 are shown in FIGS. 3 and 4, respectively. As can be noted from FIG. 4, the vertical component of the magnetic field in the cell is extremely large at the ends on the upstream side (with respect to the flow of direction of the current), whereas small at the ends on the downstream side or at the central portion of the cell with the result that, especially near the shorter end walls, the gradient of the vertical component of the magnetic field increases from the upper stream side toward the lower stream side. Such large gradient makes unstable the aluminum metal layer 6. In other words, the aluminum metal layer 6 could be stabilized if it were possible to decrease or eliminate such gradient.

Figure 5:
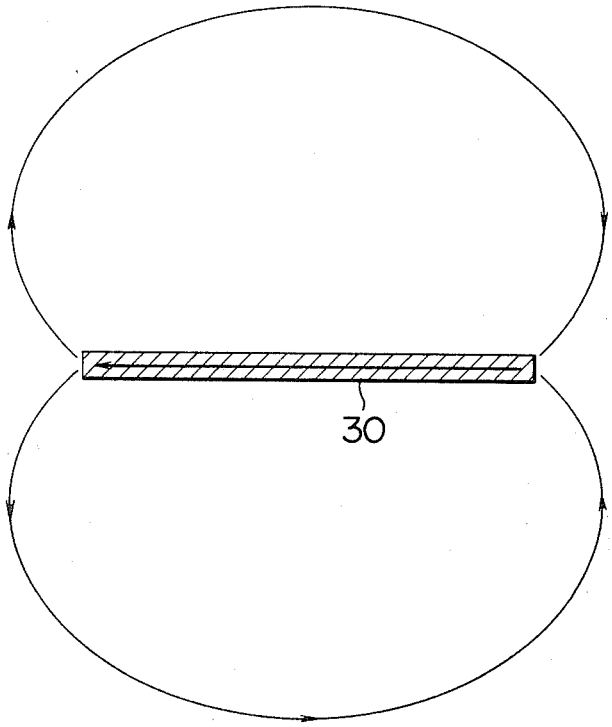
FIG. 5 is a diagram showing magnetic field formed about a ferromagnetic rod magnetized in the horizontal direction.
Figure 6:
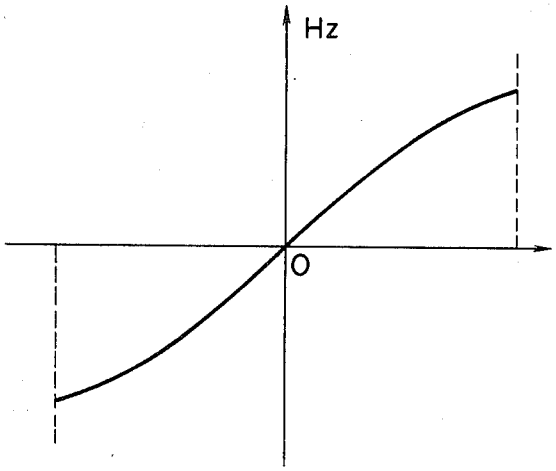
FIG. 6 is a graph showing the vertical component of the magnetic field in which the abscissa represents the distance from the center of the ferromagnetic rod, while the ordinate the intensity of the vertical component.
Figure 7:
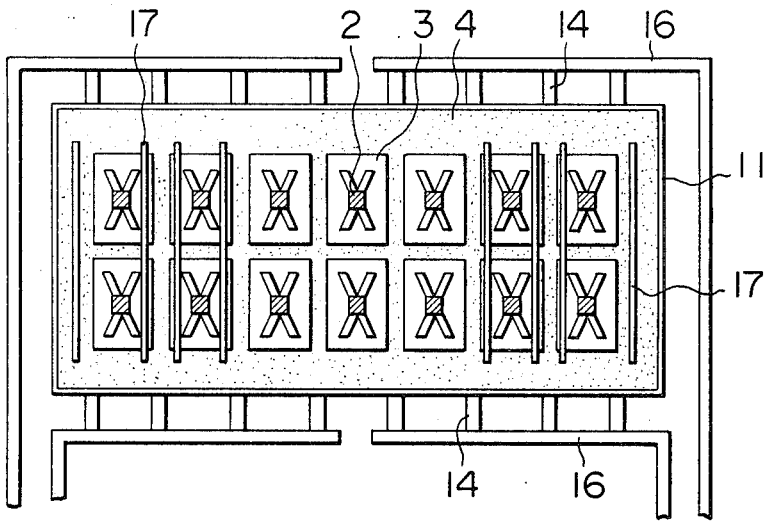
FIG. 7 is a diagrammatic cross-sectional view of an electrolytic cell provided with a plurality of ferromagnetic rods according to the teaching of the invention.

According to this invention, for the purpose of decreasing the gradient of the vertical component of the magnetic field, elongated ferromagnetic member or members are disposed in the horizontal direction above or below the aluminum metal layer. The magnetic flux formed about a ferromagnetic member, in this case a steel rod 30, and the variation in the horizontal direction of the vertical component of the magnetic field under the ferromagnetic member are shown in FIGS. 5 and 6 respectively. As shown in FIG. 6, the vertical component of the magnetic field created by the ferromagnetic member magnetized in the horizontal direction has a gradient or sloped. For this reason, when the ferromagnetic member is disposed such that the vertical component of the magnetic field created by the ferromagnetic member would have a gradient opposite to that of the vertical component shown in FIG. 4, it would be possible to decrease or eliminate the gradient of the vertical component of the magnetic field. For example, in an electrolytic cell as shown in FIG. 2 when ferromagnetic members, for example in the form of flat steel rods 17, are disposed above the aluminum metal layer in parallel with the shorter end walls of the cell as shown in FIG. 7, these ferromagnetic members will be magnetized in the direction of the horizontal component parallel to the shorter end walls of the magnetic field which rotates in the clockwise direction as viewed in FIG. 3, so that it is possible to efficiently decrease the gradient of the vertical component of the magnetic field shown in FIG. 4. Among the ferromagnetic members, those located near the side walls at which the gradient is the maximum, are most effective so that it is not always necessary to provide the ferromagnetic members for the anode electrodes at the central portion of the cell. In the example shown in FIG. 7, the ferromagnetic members 17 are disposed above the alumina overlying the crust and above the prebaked anode electrodes in parallel with the shorter end walls. It is desirable to position the ferromagnetic members at positions as close as possible to the aluminum metal layer to use them most efficiently. When the ferromagnetic members are located above the prebaked anode electrodes, it is advantageous to mount the ferromagnetic members directly on the anode electrodes or hang the members from an upper structure of the cell to reach positions near the upper surfaces of the anode electrodes. When the ferromagnetic members are mounted on the prebaked anode electrodes, each member is divided into two parts, but when these two parts are not separated too much, their advantageous effect does not decrease appreciably.

In the electrolytic cell shown in FIG. 2, it is also possible to dispose the ferromagnetic members such that they will be magnetized by the horizontal component of the magnetic field which is parallel with the longer side walls of the cell, as shown in FIG. 3. In this case, since the magnetic field having a gradient opposite to that shown in FIG. 4 is to be formed in the aluminum metal layer, the ferromagnetic members are disposed beneath the aluminum metal layer so as to utilize the vertical component of the magnetic field created by the ferromagnetic members thereabove. In other words, the ferromagnetic members should be disposed beneath the aluminum metal layer in parallel with and near the longer side walls.

Figure 8:
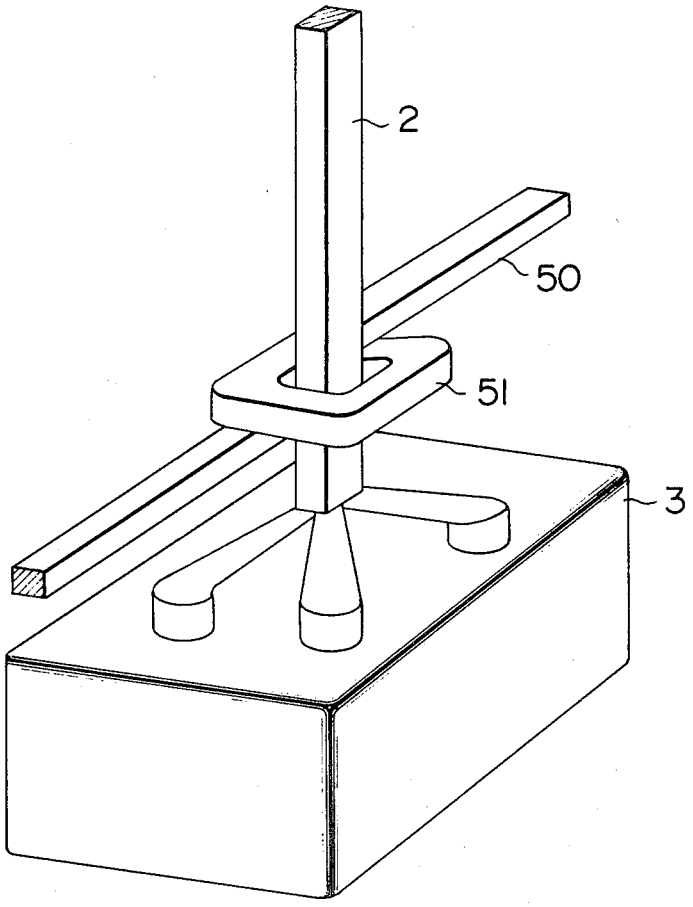
FIG. 8 is a perspective view showing an anode electrode and a ferromagnetic bar wrapped about an anode rod and extending in the horizontal direction.

Although in the foregoing description, the ferromagnetic members were disposed to be magnetized by the horizontal component of the magnetic field created by the current flowing through the electrolytic cell, it should be understood that the ferromagnetic members can also be magnetized by a magnetic field encircling a conductor carrying the current flowing through the cell. In this case, the ferromagnetic member is shaped into a coil of one or more turns surrounding a current carrying conductor with both ends of the coil extended in the horizontal direction. For example, in the embodiment shown in FIG. 8, a ferromagnetic member 50 in the form of a rectangular steel bar is wound about an anode rod 2 to form a single turn coil 51. The current carrying conductor may be an anode rod, or an anode bus bar.

Any ferromagnetic material can be used to form a ferromagnetic member, but mild steel is most advantageous from the standpoint of cost.

Figure 9:
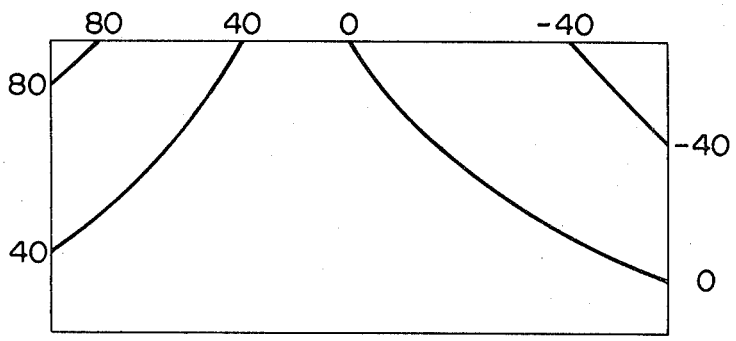
FIG. 9 is graph showing the distribution of the vertical component of the magnetic field in terms of Gauss units created in the electrolytic cell according to this invention.

FIG. 9 shows one example of the distribution of the vertical component of the magnetic field in the aluminum metal layer of an electrolytic cell provided with a ferromagnetic member according to this invention in which the vertical component is depicted as calculated values where ferromagnetic members 17 are disposed as shown in FIG. 7 in an electrolytic cell shown in FIG. 2 having the vertical component of the magnetic field as shown in FIG. 4.

The calculation was made according to the following conditions:

| | | |
|---|---|---|
| 1. | size of the electrolytic cell | width 3 m<br>length 7 m |
| 2. | intensity of magnetization of a ferromagnetic member | 0.5 $Wb/m^2$ |
| 3. | size of a ferromagnetic member | length 300 cm<br>sectional area 210 $cm^2$ |
| 4. | distance between a ferromagnetic member and aluminum metal layer | 70 cm |
| 5. | number of the ferromagnetic members | 8 |

Comparison of FIG. 4 with FIG. 9 clearly shows that the gradient of the vertical component of the magnetic field has been substantially decreased according to this invention. In this example, since the ferromagnetic members are disposed near and parallel with the shorter end walls of the electrolytic cell, the gradient of the vertical component of the magnetic field has been remarkably decreased at and near such positions. As a result of such a remarkable decrease in the gradient of vertical component, the variation in the level of the interface between the electrolytic bath and the aluminum metal layer decreases to a minimum thus stabilizing the aluminum metal layer. In FIG. 9, where it is desired to further decrease the gradient of the vertical component of the magnetic field in the longitudinal direction of the cell, a ferromagnetic member may be disposed below the aluminum metal layer along the longer side walls of the cell.

As above described, according to this invention, since one or more ferromagnetic members are disposed in a direction in which the gradient of the vertical component of the magnetic field created by the current flowing through an electrolytic cell is desired to be decreased, the variation in the level of the interface between an electrolytic bath and an aluminum metal layer can be decreased so as to stabilize the aluminum metal layer. This enables the cell to operate stably at high current efficiencies with an appropriate interelectrode spacing.

I claim:

1. A method of stabilizing an aluminum metal layer in a prebaked anode type aluminum electrolytic cell comprising the steps of:

horizontally disposing a ferromagnetic member in a magnetic field created by a current passing through said electrolytic cell, and magnetizing said ferromagnetic member with a horizontal component of said magnetic field so as to form a magnetic field containing a vertical component that decreases a gradient of a vertical component of said first mentioned magnetic field.

2. An apparatus for stabilizing an aluminum metal layer in a prebaked anode type aluminum electrolytic cell having longitudinally extending walls and shorter end walls in which alumina is electrolyzed by electric current flowing through an electrolyte interposed between at least one anode electrode and a cathode electrode, said apparatus comprising at least one horizontal ferromagnetic member disposed in a magnetic field created by a current passing through said electrolytic cell to be magnetized with a horizontal component of said magnetic field for forming a magnetic field containing a vertical component that decreases a gradient of vertical component of said first mentioned magnetic field.

3. The apparatus according to claim 2 wherein said ferromagnetic member is disposed on said prebaked anode electrodes positioned close to said shorter end walls in parallel therewith.

4. The apparatus according to claim 2 wherein said ferromagnetic member is disposed above said aluminum metal layer in parallel with shorter end walls of said container.

5. The apparatus according to claim 2 wherein said ferromagnetic member is disposed beneath said aluminum metal layer in parallel with a longer side wall of said cell.

6. The apparatus according to claim 2 wherein said ferromagnetic member is disposed above said anode electrode.

7. The apparatus according to claim 6 wherein said ferromagnetic member is wound about an electroconductive rod supporting said anode electrode to form a coil about said rod, opposite terminals of said coil extending in the horizontal direction.

8. The apparatus according to claim 6 wherein said ferromagnetic member is wound about an anode bus bar connected to said anode electrode.

* * * * *